US007240397B2

(12) United States Patent
Han

(10) Patent No.: US 7,240,397 B2
(45) Date of Patent: Jul. 10, 2007

(54) REFRIGERATOR

(75) Inventor: Jae Myung Han, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 54 days.

(21) Appl. No.: 10/820,023

(22) Filed: Apr. 8, 2004

(65) Prior Publication Data

US 2005/0273974 A1 Dec. 15, 2005

(30) Foreign Application Priority Data

Jul. 31, 2003 (KR) ..... 10-2003-0053145

(51) Int. Cl.
*E05F 3/20* (2006.01)

(52) U.S. Cl. ..... 16/50; 16/273; 16/286

(58) Field of Classification Search ..... 16/273, 16/277, 281, 286, 80, 70, 50, 374, 375, 319; 312/401, 405, 325–326, 329, 319.2; 49/399, 49/109

See application file for complete search history.

(56) References Cited

U.S. PATENT DOCUMENTS

| | | | | | |
|---|---|---|---|---|---|
| 513,042 | A * | 1/1894 | Gridley | 16/274 |
| 1,195,085 | A * | 8/1916 | Raber | 16/274 |
| 2,635,281 | A * | 4/1953 | Feldberg | 16/276 |
| 2,750,620 | A * | 6/1956 | Clarke | 16/274 |
| 3,421,177 | A * | 1/1969 | Broghammer | 16/263 |
| 4,151,681 | A * | 5/1979 | Roberts | 49/382 |
| 4,215,449 | A * | 8/1980 | Loikitz | 16/50 |
| 4,234,760 | A * | 11/1980 | Lawson | 174/138 F |
| 5,027,473 | A * | 7/1991 | Hottmann | 16/286 |
| 5,158,503 | A * | 10/1992 | Mitchell | 16/278 |
| 5,265,954 | A * | 11/1993 | Keil | 312/405 |
| 5,271,652 | A * | 12/1993 | Watanabe et al. | 296/36 |
| 5,272,789 | A * | 12/1993 | Mitchell et al. | 16/291 |
| 5,392,494 | A * | 2/1995 | Wronski | 16/364 |
| 5,522,656 | A * | 6/1996 | Jenkins | 292/79 |
| 5,896,619 | A * | 4/1999 | Koopman | 16/50 |
| 5,931,554 | A * | 8/1999 | Koopman | 312/405 |
| 6,845,545 | B2 * | 1/2005 | Han et al. | 16/277 |

FOREIGN PATENT DOCUMENTS

| | | | |
|---|---|---|---|
| CA | 2421890 | A1 * | 9/2004 |
| JP | 59048355 | A * | 3/1984 |
| KR | 2001-26264 | | 4/2001 |

* cited by examiner

*Primary Examiner*—Chuck Y. Mah
(74) *Attorney, Agent, or Firm*—Staas & Halsey LLP

(57) ABSTRACT

A refrigerator having a cabinet with a pair of hinge holes, a door having a pair of hinge shafts and being rotatably coupled to the cabinet by engagement between the pair of hinge shafts and the pair of hinge holes, and a door-closing device to allow the door to be automatically closed toward the cabinet, the door-closing device including an auxiliary hinge shaft attached to a bottom of the door; a restoring unit in a bottom of the cabinet to bias the door toward the cabinet when the door is opened; a hinge lever connected between the auxiliary hinge shaft and the restoring unit and having a coupling hole in which the auxiliary hinge shaft fits; and a cap fitted on an end of the hinge lever where the coupling hole is formed.

9 Claims, 2 Drawing Sheets

REFRIGERATOR

CROSS-REFERENCE TO RELATED APPLICATIONS

This application claims the benefit of Korean Application No. 2003-53145, filed Jul. 31, 2003, in the Korean Intellectual Property Office, the disclosure of which is incorporated herein by reference.

BACKGROUND OF THE INVENTION

1. Field of the Invention

The present invention relates to a refrigerator and, more particularly, to a door-closing device for a refrigerator, which enables a door of the refrigerator to be automatically closed when the door is opened to a predetermined angle or less.

2. Description of the Related Art

Generally, a refrigerator generates cool air by a refrigerating cycle, and supplies the cool air into storage compartments to maintain the freshness of food stored in the storage compartments for a desired period of time.

A typical refrigerator includes a cabinet opening at a front face thereof with a storage compartment therein, and a door hingedly coupled to the front face of the cabinet to open and close the storage compartment.

The door includes upper and lower hinge shafts joined to both ends of a side thereof, which serve as a rotating axis, and the cabinet includes upper and lower hinge holes at upper and lower panels thereof, corresponding to the upper and lower hinge shafts. Accordingly, the door is swingably coupled to the cabinet by the upper and lower hinge shafts fitted in the hinge holes, to open and close the storage compartment.

A conventional refrigerator has a door-closing device that allows a door to be automatically closed when the door is opened to a predetermined angle or less. The door-closing device allows the door to be automatically closed even when the door is not correctly closed due to a user's carelessness, thereby preventing cool air in the storage compartment of the refrigerator from leaking out.

The conventional door-closing device includes a hinge bracket attached to a lower end of the door, a hinge shaft, an auxiliary hinge shaft spaced apart from the hinge shaft, and an actuating lever attached to the cabinet and hingedly connected to the auxiliary hinge shaft at the front end of the actuating lever. A restoring unit is provided at a rear end of the actuating lever to retract the actuating lever into the cabinet when the door is opened. Accordingly, when the door is opened by a predetermined angle or less, the actuating lever is rearwardly moved to the stored potential energy of the restoring unit, thereby allowing the door, connected to the actuating lever via the auxiliary hinge shaft, to be automatically closed.

The actuating lever includes a coupling hole in which the auxiliary hinge shaft is fitted. A grommet, which is adapted to sheathe the auxiliary hinge shaft, is fitted into the coupling hole of the actuating lever to prevent abrasion of the auxiliary hinge shaft and the actuating lever during opening and closing operations of the door. The lower end of the auxiliary hinge shaft i has a coupling portion with an external diameter smaller than that of the remaining portion of the auxiliary hinge shaft to enable the coupling portion to be fitted into the grommet. Because the grommet includes a flange at an upper end thereof, which is supported on an upper surface of the actuating lever adjacent to the coupling hole, the grommet is stably retained in the coupling hole of the actuating lever without separating from the actuating lever.

In the conventional refrigerator, although grease is usually applied to the coupling hole of the actuating lever into which the grommet and the auxiliary hinge shaft are fitted to facilitate opening and closing operations of the door and to prevent abrasion of the components associated with the coupling hole, the grease applied to the coupling hole and the actuating lever may detract from the appearance of the cabinet because extraneous substances such as dust may adhere to the grease due to exposure to the external environment.

Furthermore, because the grommet is made of a plastic material produced by injection molding while the auxiliary hinge shaft and the actuating lever are made of metal, the flange of the grommet, which is interposed between the auxiliary hinge shaft and the actuating lever, may wear and thus generate undesired noise due to the repeated opening and closing operations of the door.

SUMMARY OF THE INVENTION

Accordingly, it is an aspect of the present invention to provide a refrigerator with an improved door-closing device to reduce abrasion of components associated with the door-closing device due to opening and closing operations of a door and, thus, reduce noise due to the abrasion, as well as to achieve a more esthetically pleasing appearance.

Additional aspects and/or advantages of the invention will be set forth in part in the description which follows and, in part, will be obvious from the description, or may be learned by practice of the invention.

To achieve the above and/or other aspects of the present invention, there is provided a refrigerator including a cabinet with a pair of hinge holes, a door having a pair of hinge shafts and being rotatably coupled to the cabinet by engagement between the pair of hinge shafts and the pair of hinge holes, and a door-closing device to allow the door to be automatically closed toward the cabinet, the door-closing device including an auxiliary hinge shaft attached to a bottom of the door; a restoring unit in a bottom of the cabinet to bias the door toward the cabinet when the door is opened; a hinge lever connected between the auxiliary hinge shaft and the restoring unit and having a coupling hole in which the auxiliary hinge shaft fits; and a cap fitted on an end of the hinge lever where the coupling hole is formed.

The refrigerator may further include a grommet fitted in the coupling hole of the hinge lever and receiving the auxiliary hinge shaft, an upper end of the grommet having a flange that radially extends from the grommet and that is supported on the hinge lever, with the cap being interposed between the flange and the hinge lever.

The refrigerator may further include a grease container, attached to a lower surface of the cap and having an opening in a top thereof, to hold grease therein.

An internal diameter of the grease container may be larger than a diameter of the coupling hole.

The cap may include a slot at a side thereof to receive the hinge lever, and has upper and lower through-holes formed at upper and lower walls of the cap to allow the auxiliary hinge shaft to pass therethrough.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
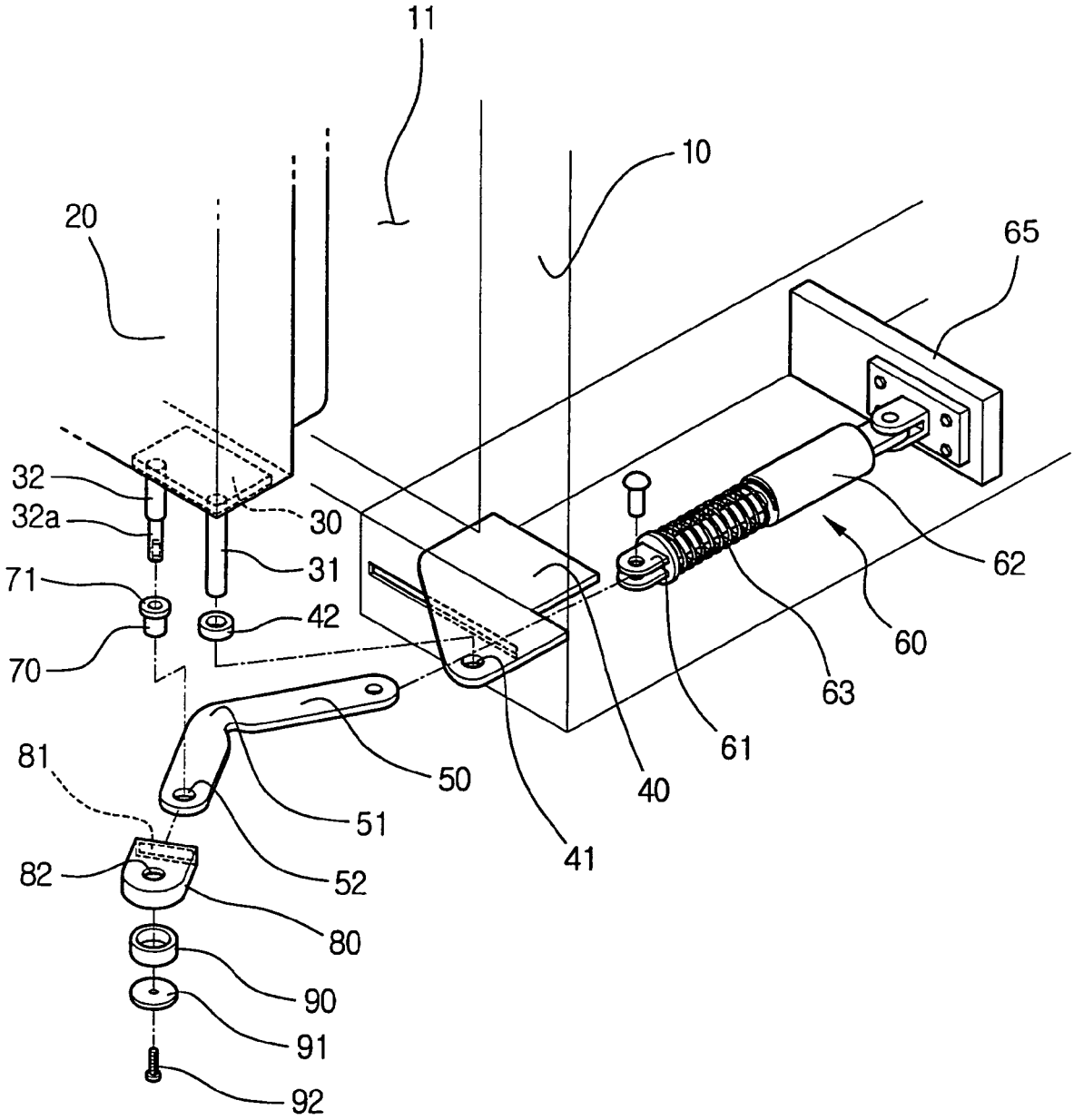
FIG. 1 is an exploded perspective view of a door-closing device of a refrigerator, according to an embodiment of the present invention.

Reference will now be made in detail to the embodiment of the present invention, examples of which are illustrated in the accompanying drawings, wherein like reference numerals refer to the like elements throughout. The embodiment is described below to explain the present invention by referring to the figures.

As shown in FIG. 1, a refrigerator according to an embodiment of the present invention includes a cabinet 10 opening at a front face thereof, a storage compartment 11 therein, and a door 20 hingedly coupled to the front face of the cabinet 10 to open and close the storage compartment 11.

The door 20 includes a pair of hinge shaft brackets 30 at upper and lower ends of a side thereof. Each of the hinge shaft brackets 30 includes a main hinge shaft 31 serving as the rotating axis of the door 20. The cabinet 10 has a pair of hinge hole brackets 40 at locations corresponding to the pair of hinge shaft brackets 30. The hinge hole brackets 40 have hinge holes 41 respectively corresponding to the main hinge shafts 31 to allow the main hinge shafts 31 of the hinge shaft brackets 30 to be rotatably fitted in the hinge holes 41 of the hinge hole brackets 40. Washers 42 are respectively interposed between the main hinge shafts 31 and the hinge hole brackets 40. The door 20 rotates about the main hinge shafts 31 respectively fitted in the hinge holes 41, thus opening and closing the storage compartment 11.

The refrigerator according to the embodiment of the present invention further includes a door-closing device, which allows the door 20 to automatically close toward the cabinet 10 when the door is opened about the main hinge shafts 31 to a predetermined angle or less.

The door-closing device includes an auxiliary hinge shaft 32 provided on the lower hinge shaft bracket 30 that is spaced apart from the main hinge shaft 31, a hinge lever 50 provided at a lower portion of the cabinet 10 and hingedly connected at a front end thereof to the auxiliary hinge shaft 32, and a restoring unit 60 hingedly connected to a rear end of the hinge lever 50 to restore the hinge lever 50 to a resting position when the hinge lever 50 is moved forward by opening the door 50.

The restoring unit 60 includes a movable rod 61 connected at a front end thereof to the rear end of the hinge lever 50 and having a piston part (not shown) provided at a rear end thereof, and a housing 62 to receive the piston part (not shown) of the movable rod 61 therein. The housing 62 is swingably connected to a mount plate 65 fixed to a lower end of the cabinet 10. The movable rod 61 has an elastic member 63 fitted on an outer surface of the movable rod 61. The elastic member 63 is secured at a front end thereof to the front end of the movable rod 61, and secured at a rear end thereof to the housing 62. The elastic member 63 biases the movable rod 61 rearward, thereby causing the door 20 to close. The hinge lever 50 is bent at a middle portion 51 thereof, so that the door 20 automatically closes when the door 20 is opened to a predetermined angle or less, but remains in the opened position when the door 20 is opened more than the predetermined angle. Accordingly, when the door 20 is opened by a predetermined angle or less, the hinge lever 50 is retracted into the cabinet 10 by the restoring unit 60, thereby allowing the door 20, connected to the hinge lever 50 via the auxiliary shaft 32, to automatically close.

The front end of the hinge lever 50 is formed with a coupling hole 52 that rotatably receives the auxiliary hinge shaft 32. A cylindrical grommet 70 fits in the coupling hole 52 of the hinge lever 50 to prevent abrasion of contacting surfaces between the auxiliary hinge shaft 32 and the edge of the coupling hole 52.

A lower end of the auxiliary hinge shaft 32 has a coupling portion 32*a* having a reduced external diameter to allow the lower end of the auxiliary hinge shaft 32 to fit in the grommet 70. The grommet 70 includes an upper flange 71 to prevent the grommet 70 fitted in the coupling hole 52 of the hinge lever 50 from being downwardly separated from the coupling hole 52. Therefore, it is possible to avoid direct contact between the auxiliary hinge shaft 32 and the edge of the coupling hole 52 of the hinge lever 50 by the interposition of the grommet 70.

To diminish noise due to opening and closing operations of the door 20, as well as to prevent abrasion of the edge of the coupling hole 52 of the hinge lever 50, the grommet 70 fitted in the coupling hole 52, and the auxiliary hinge shaft 32, grease is applied to the coupling hole 52 of the hinge lever 50 and the grommet 70. The front end of the hinge lever 50, where the coupling hole 52 is formed, is sheathed with a cap 80 to prevent the grease applied to the components from being exposed outside the refrigerator.

The cap 80 fits on the front end of the hinge lever 50. The cap 80 is formed, at a rear side thereof, with a slot 81, and is formed at upper and lower surfaces thereof with through-holes 82.

Because the cap 80 prevents the grease, applied to the components associated with the coupling hole 52, from being exposed, the refrigerator has a neater appearance. Furthermore, because the cap 80 fits on the hinge lever 50 prior to the auxiliary hinge shaft 32 and the grommet 70 being inserted into the coupling hole 52 of the hinge lever 50, and because the grommet 70 fits in the coupling hole 52 of the hinge lever 50 such that the flange 71 of the grommet 70 is supported on an upper wall of the cap 80, it is possible to prevent abrasion of the flange 71 of the grommet 70 during opening and closing operations of the door 20.

In a conventional hinge arrangement, because the grommet is made of a plastic material produced by an injection molding process, and the flange of the grommet is in direct contact with an upper surface of the hinge lever, the plastic flange may wear.

Figure 2:
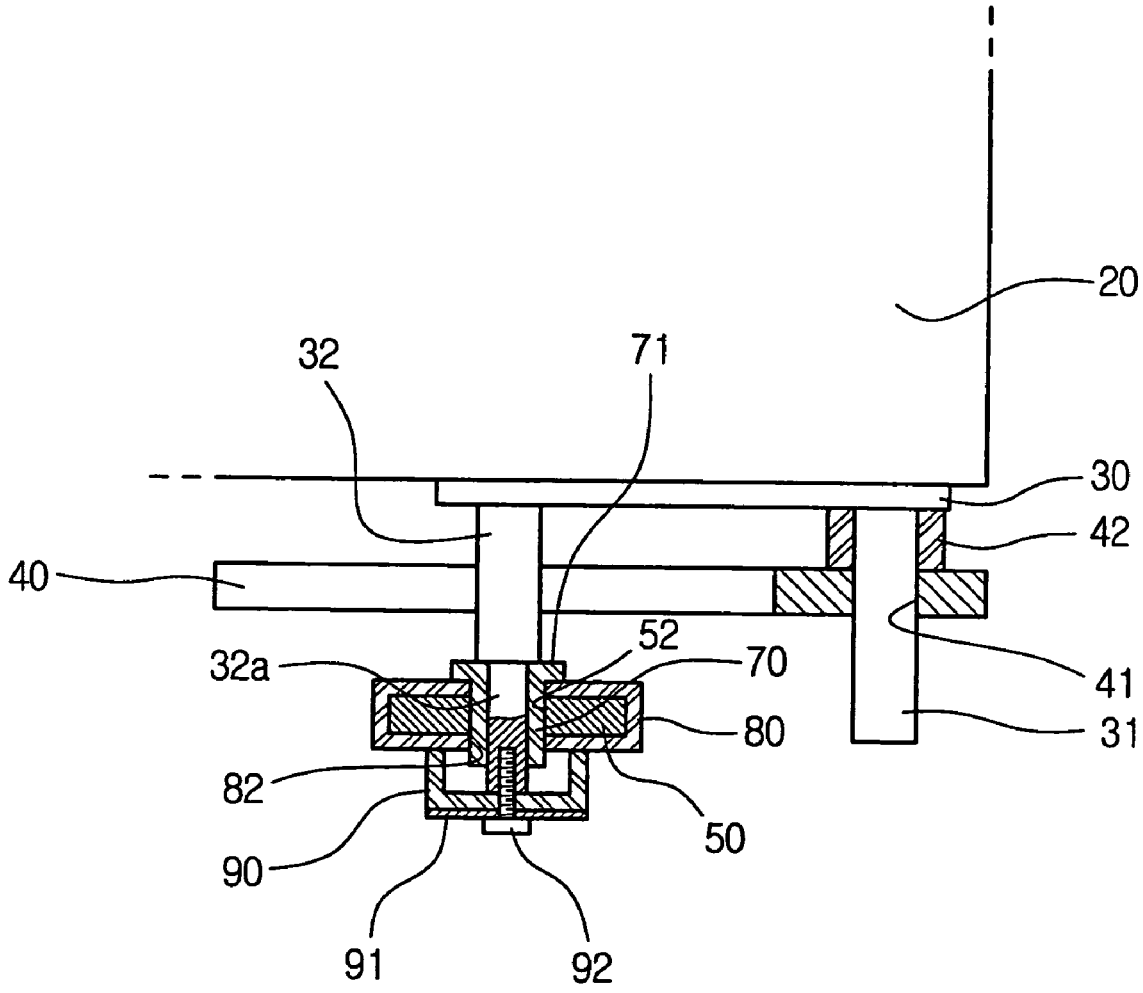
FIG. 2 is a cross-sectional view of the door-closing device of the refrigerator shown in FIG. 1.

In contrast, in the embodiment of the present invention, because the upper wall of the cap 80 is interposed between the flange 71 and the hinge lever 50, as shown in FIG. 2, the flange 71 of the grommet 70 is prevented from directly contacting the hinge lever 50. Accordingly, even though the door 20 is repeatedly opened and closed over a long period of time, abrasion of the flange 71 of the grommet 70 due to contact with the hinge lever 50 is prevented, and, thus, abnormal noise due to abrasion is diminished.

A grease container 90 is attached to a lower surface of the cap 80 to contain grease therein. The grease held in the grease container 90 permeates into a gap between the auxiliary hinge shaft 32 and the grommet 70 and into a gap between the grommet 70 and the hinge lever 50, thereby diminishing abrasion of the components and, thus, noise due to the abrasion.

A washer 91 is provided on a lower surface of the grease container 90. The washer 91 and the grease container 90 are attached to the lower surface of the cap 80 by a screw 92, which passes through the washer 91 and the grease container 90 and is fixed to the auxiliary hinge shaft 32. An internal diameter of the grease container 90 is larger than a diameter of the coupling hole 52 to allow the grease to drop into the grease container 90, thus preventing the grease from dropping onto the floor if the grease drips.

Assembly operation of the door-closing device of the refrigerator according to the embodiment of the present invention will now be described.

First, a certain amount of grease is applied to an inner surface of the cap 80, and the front end of the hinge lever 50, having the coupling hole 52, is inserted into the cap 80 through the slot 81. As a result, the through-holes 82 formed at the upper and lower walls of the cap 80 are aligned with the coupling hole 52 of the hinge lever 50. The rear end of the hinge lever 50 is connected to the front end of the movable rod 61 of the restoring unit 60.

Grease is applied to the outer surface of the grommet 70, and then the grommet 70 is fitted into the coupling hole 52 of the hinge lever 50 through the through-hole 82 of the cap 80. The flange 71 of the grommet 70 is supported on the upper surface of the cap 80 adjacent to the through-hole 82.

The door 20 is mounted on the cabinet 10 such that the main hinge shaft 31 of the hinge shaft bracket 30 attached to the door 20 i fits into the hinge hole 41 of the hinge hole bracket 40 attached to the cabinet 10, while the coupling portion 32*a* of the auxiliary hinge shaft 32, with the grommet 70 sheathed thereon, fits into the coupling hole 52 of the hinge lever 50.

The grease container 90, filled with a certain amount of grease, is disposed under the cap 80, and the washer 91 is disposed under the grease container 90. Finally, the grease container 90 is firmly attached to the lower surface of the cap 80 by tightening the screw 92 into the auxiliary hinge shaft 32 through the washer 91 and the grease container 90.

Thus, when the door 20 is opened to a predetermined angle or less, the hinge lever 50 is rearwardly retracted into the cabinet 10 by the restoring unit 60, causing the door 20, which is connected to the hinge lever 50 via the auxiliary hinge shaft 32, to automatically close due to the retraction of the hinge lever 50.

As is apparent from the above description, the present invention provides a door-closing device for a refrigerator, in which a hinge lever 50 is sheathed with a cap 80, an upper wall of which is interposed between a flange 71 of a grommet 70 and the hinge lever 50. Accordingly, because grease applied to a coupling hole 52 of the hinge lever 50 is not exposed to the external environment, an external appearance of the refrigerator becomes neater. Furthermore, because the flange 71 of the grommet 70 does not directly contact the hinge lever 50 due to the cap 80 being interposed therebetween, abrasion of the flange 71 of the plastic grommet 70, due to direct contact with the hinge lever 50 during opening and closing operations of the door, is prevented, thereby reducing undesired noise.

In addition, because the hinge arrangement is provided with a grease container 90 containing grease therein, the abrasion of the associated components and the noise due to the abrasion are more efficiently reduced or prevented.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A refrigerator having a cabinet with a pair of hinge holes, a door having a pair of hinge shafts and being rotatably coupled to the cabinet by engagement between the pair of hinge shafts and the pair of hinge holes, and a door-closing device to allow the door to be automatically closed toward the cabinet, the door-closing device comprising:

an auxiliary hinge shaft attached to a bottom of the door;

a restoring unit in a bottom of the cabinet to bias the door toward the cabinet when the door is opened;

a hinge lever connected between the auxiliary hinge shaft and the restoring unit and having a coupling hole in which the auxiliary hinge shaft fits;

a cap fitted on an end of the hinge lever where the coupling hole is formed, wherein the cap comprises a slot at a side thereof to receive the hinge lever, upper and lower through-holes formed at upper and lower walls of the cap such that the auxiliary hinge shaft passes through the upper and lower through-holes of the cap and the coupling hole of the hinge lever; and a grommet fitted in the coupling hole of the hinge lever and receiving the auxiliary hinge shaft, an upper end of the grommet having a flange that radially extends from the grommet and that is supported on the hinge lever, with the cap being interposed between the flange and the hinge lever.

2. The refrigerator of claim 1, further comprising a grease container, attached to a lower surface of the cap and having an opening in a top thereof, to hold grease therein.

3. The refrigerator of claim 2, wherein an internal diameter of the grease container is larger than a diameter of the coupling hole.

4. A door closing device for a refrigerator having a cabinet and a door hingedly connected to the cabinet, the door closing device comprising:

an auxiliary hinge shaft attached to a bottom of the door;

a restoring unit in a bottom of the cabinet to bias the door toward the cabinet to automatically close the door;

a hinge lever between the auxiliary hinge shaft and the restoring unit, and having a coupling hole at an end of the hinge lever to receive the auxiliary hinge shaft;

a cap placed on the end of the hinge lever having the coupling hole to prevent grease applied to the hinge lever and the coupling hole from being exposed outside the refrigerator, wherein the cap has a slot at a side thereof to receive the hinge lever, and has an upper through-hole and a lower through-hole formed respectively at an upper wall and a lower wall of the cap such that the auxiliary hinge shaft passes through the upper and lower through-holes of the cap and the coupling hole of the hinge lever; and a grommet fitted in the coupling hole of the hinge lever and receiving the auxiliary hinge shaft to Prevent abrasion between the auxiliary hinge shaft and the coupling hole, the grommet having a flange at an upper end thereof that radially extends from the grommet and is supported by an upper wall of the cap to hold the grommet within the coupling hole, the cap being interposed between the flange and the hinge lever to prevent abrasion between the flange and the hinge lever and to reduce noise.

5. The door closing device of claim 4, wherein the restoring unit comprises:

a movable rod having a front end connected to a rear end of the hinge lever;

a housing having a rear end rotatably connected to a lower end of the cabinet; and an elastic member surrounding an outer surface of the movable rod and having a front end connected to the front end of the movable rod and a rear end connected to a front end of the housing, the elastic member biasing the movable rod rearward to automatically close the door.

6. The door closing device of claim 5, wherein the hinge lever is bent at a middle portion thereof to automatically close the door when the door is opened up to a predetermined angle and the restoring unit retracts the hinge lever into the cabinet, while maintaining the door in the opened position when the door is opened more than the predetermined angle.

7. The door closing device of claim 4, wherein grease is applied to the coupling hole and to the grommet to reduce noise and abrasion of the coupling hole, the hinge lever, and the grommet.

8. The door closing device of claim 4, further comprising a grease container attached to a lower surface of the cap and having an opening in a top thereof to hold grease therein, the grease held in the grease container permeating into a gap between the auxiliary hinge shaft and the grommet and into a gap between the grommet and the hinge lever, to reduce abrasion and noise generated due to the abrasion.

9. The door closing device of claim 8, wherein an internal diameter of the grease container is larger than a diameter of the coupling hole to allow the grease to drop into the grease container, thereby preventing the grease from dripping outside the door closing device.

* * * * *